United States Patent [19]

Lavedan, Jr. et al.

[11] 3,932,823

[45] Jan. 13, 1976

[54] MICROSTRIP TO WAVEGUIDE ADAPTER

[75] Inventors: Louis J. Lavedan, Jr., Springfield, Va.; Carlton S. Collings, Jr., New York, N.Y.

[73] Assignee: The United States of America as represented by the Secretary of the Navy, Washington, D.C.

[22] Filed: Apr. 23, 1975

[21] Appl. No.: 571,039

[52] U.S. Cl. ..... 333/21 R; 333/35; 333/84 M

[51] Int. Cl.[2] ..... H01P 1/16

[58] Field of Search ..... 333/21 R, 33, 35, 84 M

[56] References Cited

UNITED STATES PATENTS

| | | | |
|---|---|---|---|
| 3,265,995 | 8/1966 | Hamasaki | 333/21 R |
| 3,483,489 | 12/1969 | Dietrich | 333/21 R |

*Primary Examiner*—Paul L. Gensler

*Attorney, Agent, or Firm*—R. S. Sciascia; P. Schneider; W. T. Ellis

[57] ABSTRACT

A method for permitting the use of "drop-in" waveguide structures in microstrip applications comprising the steps of: inserting a heavily loaded waveguide that is compatible in size to the stripline into a longitudinal hole cut in the stripline to accommodate the waveguide so that these two components are end-to-end;

attaching the ground plane of the stripline directly to one of the broad-walls of the waveguide; and impedance matching the top, narrow conductor of the stripline to the waveguide completely external to said waveguide and attaching it to the remaining waveguide broad-wall.

3 Claims, 4 Drawing Figures

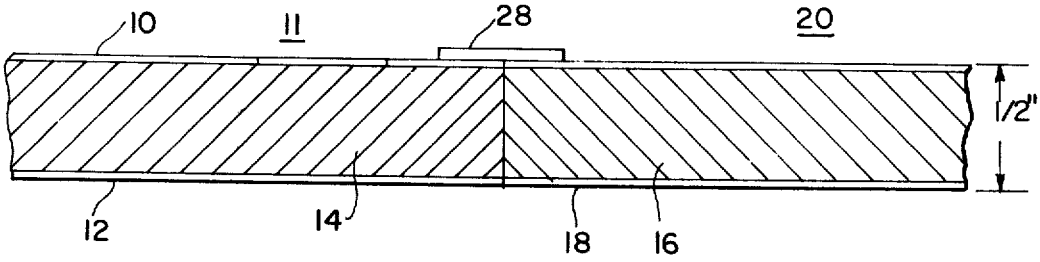
FIG. 1a
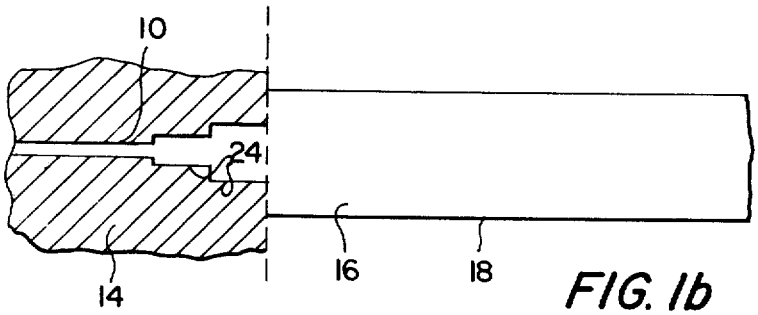
FIG. 1b
FIG. 1c
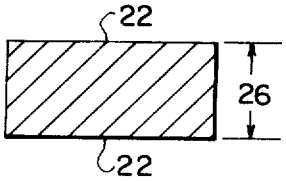
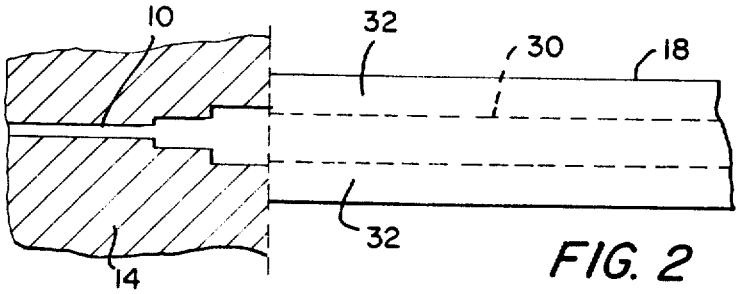
FIG. 2

MICROSTRIP TO WAVEGUIDE ADAPTER

BACKGROUND OF THE INVENTION

1. Field of the Invention

The present invention relates generally to microwave energy transfer apparatus and in particular to an improved transition structure for transferring microwave energy from a strip-type transmission line to a loaded waveguide.

2. Decription of the Prior Art

Microstrip transmission lines comprising flat, narrow conductors etched or otherwise suitably fixed on a printed circuit board (which provides a spaced ground plane) have come into common use at radio frequencies. These transmission lines are particularly advantageous because of their light weight, small volume, and ease of printing. Furthermore, microstrip circuitry is easily coupled to electrical components and has wide band, low loss characteristics.

Generally, systems involving the combination of waveguide and microstrip are uncommon due to the physical size of the waveguide that is required to transmit the frequency bands normally used in microstrip lines.

Where both waveguide and microstrip lines must be used in the same system a probe structure is usually employed which effects a conversion of the microwave energy from its waveguide mode to a coaxial mode and then to a microstrip mode. Usually such probe transition devices are placed at right angles to the waveguide and protrude up through a wall into the waveguide.

There are, however, system applications where a simple, direct transition from microstrip to waveguide is desirable. For example, most ferrite phase-shifters made for microstrip are sensitive to dimensional characteristics and thus are extremely frequency-sensitive devices. In contra distinction, waveguide, ferrite phase-shifters have inherent, low-loss properties thus making them almost frequency independent. Clearly a small, direct-transition device that could be used to convert back and forth between microstrip and waveguide lines is highly desirable. For then, any frequency-sensitive microstrip device could be easily replaced by its frequency-independent, waveguide counterpart.

SUMMARY OF THE INVENTION

Briefly, the present invention provides a direct, in-line, single ground-plane, microstrip-to-waveguide transition method which eliminates the need for a coaxial mode transition. This method makes feasible the use of waveguide structures in microstrip circuitry. The method comprises attaching the single, ground plane of the microstrip to one of the broad-walls of a physically compatible waveguide to be inserted into the microstrip system. The microstrip, narrow conductor is then impedance transformed external to the waveguide and directly attached to the remaining waveguide broadwall. Such a transition can be effected by merely cutting a hole in the microstrip, setting the waveguide containing the desired circuit component into this hole so that the two lines are end-to-end, and connecting the two lines as stated above. This small, drop-in, waveguide must be heavily loaded in order to allow it to propagate the R.F. energy present in the microstrip line while remaining physically compatible with the stripline.

OBJECTS OF THE INVENTION

An object of the present invention is to eliminate the need for a coaxial-mode, transition step in waveguide microstrip transitions.

A further object of the present invention is to permit a direct, in-line transition between waveguide and microstrip lines.

A still further object is to make feasible the substitution of waveguide circuit components in microstrip circuitry.

Yet a still further object is to utilize drop-in waveguide structures in microstrip systems.

Other objects, advantages, and novel features of the present invention will become apparent from the following detailed description of the invention when considered in conjunction with the accompanying drawings.

BRIEF DESCRIPTION OF THE DRAWINGS

FIG. 1*a* is a sectioned, side view of one embodiment of the waveguide-microstrip adapter of the present invention.

FIG. 1*b* is a top view of the embodiment of the present invention shown in FIG. 1*a*.

FIG. 1*c* is a sectioned end view of the heavily loaded waveguide 20 of the present invention.

FIG. 2 is a top view of a drop in waveguide phase shifter inserted into a microstrip line.

DETAILED DESCRIPTION OF THE PRESENT INVENTION

Referring now to the drawings, FIGS. 1*a*, 1*b*, and 1*c* show the basic, stripline-to-waveguide transition of the present invention.

The basic problem in providing a transition between a stripline structure supporting an energy mode which is essentially TEM and and a waveguide structure, such as a rectangular waveguide supporting a $TE_{10}$ mode, is to obtain a propagation transition therethrough with a minimum of radiation and reflection losses at the transition. Thus a transition structure must be provided that effects both an impedance transformation and a radiation field-pattern transition.

The typical stripline comprises two flat stripconductors separated by a layer of dielectric material 14. The strip conductor 12 is considerably wider than the top, strip conductor 10 in order to present thereto a planar, conducting, base surface. The dielectric layer which may be of polyethylene, polystyrene, "Teflon", fiberglass, or other suitable material of high dielectric quality, is utilized as a supporting medium for the strip conductors 10 and 12 which may be applied thereto in the desired configuration by known printing techniques. Generally, such striplines have impedances on the order of 50 ohms. (Determined by the width of the conductor 10 and its spacing from the planar conductor 12 and the dielectric constant of the material 14 disposed therebetween).

Generally, waveguides must have width dimensions of several inches in order to propagate electro-magnetic energy at radio frequencies (R.F.). In order to obtain a waveguide that is physically compatible with the typical stripline dimensions (.5 inches wide, 40 thousandths inch spacing) while yet propagating R.F. energy, the waveguide must be heavily loaded with high dielectric material 16. This dielectric material 16 may be of alumina, styrene, plastic, or any other suitable material of high, dielectric constant or a composite thereof.

A common method of manufacture for such loaded waveguides is to use a composite of a high dielectric material and a low dielectric support material such as styrene and ceramic foam, respectively. The low dielectric material gives the composite material a good strength characteristic. The metallic walls 18 of the waveguide are then plated to a thickness of approxiamtely 0.001 to 0.002 inches around this composite loading material thus forming a loaded waveguide.

It should be understood at this point that although the present method may be used only with heavily loaded waveguides, these waveguides need not be completely filled with dielectric material. Such a complete filling of the waveguide provides added mechanical support to the waveguide and ease of manufacture, but it is not essential to the present invention. The waveguide 20 need only be heavily loaded dielectrically. No particular loading configuration is required.

The heavily loaded, waveguide section 20 is attached to the stripline in the following manner. The microstrip dielectric 14 and the narrow conductor 10 may be cut so that a hole of the dimensions of the waveguide section 20 to be inserted is obtained. The ground plane 12 of the microstrip is then attached to one of the broad walls 22 of the waveguide 20. The narrow conductor 10 of the microstrip line is then impedance transformed and directly attached to the remaining one of the waveguide broad walls 22.

The connection of the stripline conductors to the waveguide may be accomplished by any of the well-known techniques. For example, the stripline and waveguide may be butted up against each other and a metal jumper ribbon 28 (frequently of gold) connected across the two lines to effect a good electrical contact. The jumper 28 may be soldered, spot-welded, or pressure bonded across the stripline-waveguide interface.

Common microwave matching techniques may be employed to effect the impedance match between the stripline and the waveguide 20. For instance, the technique of transformer impedance steps may be employed. In this technique the band-width and VSWR are determined by the number of intermediate matching steps 24 that the narrow conductor 10 makes before it connects to one of the waveguide broad walls 22.

It should be noted that the embodiment shown in FIGS. 1*a*, 1*b*, 1*c* results typically in an impedance transformation from 50 ohms in the stripline 11 to 5–10 ohms in the waveguide 20. This type of downward transformation from the stripline to the waveguide is highly unusual and is caused by the heavy loading of the waveguide 20. (Typical characteristic impedances for R.F. waveguides range from 100 to 300 ohms and thus an upward impedance transformation is generally required). The amount of downward transformation can be reduced by increasing the waveguide height dimension 26 which has the effect of increasing the waveguide impedance.

The actual impedance transformation from the stripline to a waveguide is effected in the stripline approach to the waveguide. This transformation is accomplished in the stripline completely external to the waveguide and may be a combination of any of the well-known transformation techniques such as:

a. varying the spacing of the narrow conductor 10 above the ground plane 12 in a continuous fashion or in steps;

b. varying the width of the narrow conductor 10;

c. varying the dielectric constant of the strip-line dielectric 14 as the waveguide 20 is approached so that there is not an abrupt dielectric constant change at the stripline waveguide interface. This transition section of the stripline may be manufactured as a separate piece to be added, or formed during the manufactue of the stripline itself with well-known manufacturing techniques.

The primary advantage obtained from the foregoing transition method is the ability to use drop in waveguide structures for microstrip applications. This ability comes from the fact that the waveguide structure to be inserted has a small enough size so that it may be physically inserted into the stripline either by making a hole in the stripline or splitting the stripline. Thus any type of waveguide component could be inserted into the stripline so long as it is small in size. For example, phase shifters, mixers, or circulators could be easily dropped in to the stripline circuit without any disruption of the energy propagation in the stripline. FIG. 2 shows a drop-in phase-shifter component that may be used in microstrip applications. The only change from FIG. 1*b* is the distribution of the dielectric. The long, centrally positioned block 30 is a high dielectric material such as ferrite. The filler material 32 on either side of this block 30 is generally a low dielectric support material.

Although this technique is most suited to waveguide, drop-in, component applications, the technique may be applied to straight stripline-to-waveguide transitions. For example, the small, heavily loaded waveguide may be tapered out while reducing the dielectric loading so that a normal size, empty waveguide is formed.

Dimensions for a typical, loaded waveguide are 0.004 to 0.1 inches in height to 0.75 to 1 inches in width. Dimensions for a typical stripline are 0.5 inches wide with a 40 thousand of an inch spacing. The dielectric constants for the composite materials used for waveguide loading generally have dielectric constants varying from 2 to 50. No definite width has been shown for the stripline dielectric 14 since this is a design consideration depending on the surrounding components. Although the heights of the stripline and waveguide have been set equal in FIGS. 1*a*, 1*b*, 1*c* for convenience, this dimension may be varied for either component as stated previously.

Obviously, many modifications and variations of the present invention are possible in light of the above teachings. It is therefore to be understood that, within the scope of the appended claims, the invention may be practiced otherwise than as specifically described.

What is claimed is:

1. A method for converting between a microstrip line with a small-width conductor suspended above a ground plane and a small waveguide with at least two broad walls comprising the steps of:

heavily loading said small waveguide so that it can propagate the R.F. energy being conducted in said microstrip line;

directly attaching end-to-end the ground plane of said microstrip line to one of the broad walls of said waveguide;

matching the impedance of the small-width conductor of said microstrip line to the impedance of the other of said broad walls of said waveguide; and directly attaching end-to-end said impedanced-matched, small-width conductor to said other broad wall of said waveguide.

2. A method for converting between a microstrip line and a waveguide as defined by claim 1 wherein said step of attaching the ground plane to a broad wall comprises the steps of:

cutting a hole in the center of said microstrip line with the appropriate dimensions so that said waveguide fits into the hole longitudinally;

fitting said waveguide in said hole in said microstrip line so that it lays end-to-end with said microstrip line;

directly attaching the ground plane of said microstrip line to the broad wall of said waveguide that is closest to it.

3. A waveguide to microstrip adapter for permitting the insertion of waveguide circuit components in a microstrip system comprising:

microstrip means with one, wide, ground-plane conductor and a strip conductor of narrow width relative to said ground-plane conductor laying on a supporting medium above said ground plane conductor; and waveguide means with at least two broad walls and having a small size relative to said microstrip means, said waveguide means being heavily loaded dielectrically so that it can propagate the R.F. energy that is being propagated by said microstrip means;

said microstrip means and said waveguide means being connected end-to-end so that energy propagating in said stripline means will propagate in said waveguide means, said ground-plane conductor being connected directly to one of the broad walls of said waveguide means, said narrow conductor being impedance-matched to said waveguide means and connected to the other of said broad walls.

* * * * *